US010584690B2

(12) United States Patent
Roehm

(10) Patent No.: US 10,584,690 B2
(45) Date of Patent: Mar. 10, 2020

(54) HYDROSTATIC AXIAL PISTON MACHINE

(71) Applicant: Robert Bosch GmbH, Stuttgart (DE)

(72) Inventor: Joachim Roehm, Nagold (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/058,676

(22) Filed: Aug. 8, 2018

(65) Prior Publication Data

US 2019/0048861 A1 Feb. 14, 2019

(30) Foreign Application Priority Data

Aug. 8, 2017 (DE) ..... 10 2017 213 760

(51) Int. Cl.

| | |
|---|---|
| ***F04B 1/20*** | (2020.01) |
| ***F04B 1/2085*** | (2020.01) |
| ***F03C 1/06*** | (2006.01) |
| ***F03C 1/40*** | (2006.01) |
| ***F04B 1/324*** | (2020.01) |

(52) U.S. Cl.

CPC ..... *F04B 1/2085* (2013.01); *F03C 1/0636* (2013.01); *F03C 1/0671* (2013.01); *F03C 1/0686* (2013.01); *F04B 1/20* (2013.01); *F04B 1/324* (2013.01)

(58) Field of Classification Search

CPC ..... F04B 1/148; F04B 1/2085; F04B 1/324; F04B 27/0865; F03C 1/0671; F01B 3/0073

See application file for complete search history.

(56) References Cited

U.S. PATENT DOCUMENTS

| | | | | |
|---|---|---|---|---|
| 2,695,199 A | | 11/1954 | Blizard | |
| 3,680,932 A | | 8/1972 | Raimondi | |
| 4,543,876 A | * | 10/1985 | Heyl | F04B 1/324 417/222.1 |
| 4,710,107 A | | 12/1987 | Kanies | |
| 4,903,577 A | * | 2/1990 | Loffler | F01B 3/0035 91/488 |

(Continued)

FOREIGN PATENT DOCUMENTS

| | | |
|---|---|---|
| CH | 710 829 A1 | 9/2016 |
| DE | 844 383 | 7/1952 |

(Continued)

OTHER PUBLICATIONS

German Search Report corresponding to DE Application No. 10 2017 213 760.6, dated Apr. 20, 2018 (German language document) (12 pages).

*Primary Examiner* — Michael Leslie

(74) *Attorney, Agent, or Firm* — Maginot, Moore & Beck LLP

(57) ABSTRACT

A hydrostatic axial piston machine includes a housing and a pivot cradle. At least one slide bearing of the pivot cradle on a high-pressure side is hydrostatically relieved. The slide bearing includes one or two pairs of relief grooves. A relief pressure field develops about and between the one or two pairs of relief grooves as the grooves are supplied with relief pressure medium on one side and are closed at their outer ends. An optional slide bearing on a low-pressure side has one or two limiting grooves which delimit the relief pressure field there, as the limiting grooves are open at their outer ends.

14 Claims, 4 Drawing Sheets

(56) References Cited

U.S. PATENT DOCUMENTS

| | | | | |
|---|---|---|---|---|
| 7,086,225 | B2 * | 8/2006 | Kadlicko | F04B 1/324 60/413 |
| 2010/0018385 | A1 * | 1/2010 | Mori | F04B 1/2078 91/505 |
| 2017/0058877 | A1 * | 3/2017 | Haug | F04B 1/30 |

FOREIGN PATENT DOCUMENTS

| | | | |
|---|---|---|---|
| DE | 2 101 078 | | 8/1972 |
| DE | 29 46 921 | A1 | 6/1980 |
| DE | 34 33 895 | A1 | 3/1985 |
| DE | 37 24 285 | C2 | 2/1989 |
| DE | 601 25 881 | T2 | 11/2007 |
| DE | 10 2011 121 523 | A1 | 6/2013 |
| DE | 10 2012 214 830 | A1 | 2/2014 |
| DE | 10 2012 022 999 | A1 | 5/2014 |
| EP | 0 866 234 | A1 | 9/1998 |
| GB | 994688 | | 6/1965 |
| GB | 2 102 083 | A | 1/1983 |
| WO | 97/29291 | A1 | 8/1997 |

* cited by examiner

HYDROSTATIC AXIAL PISTON MACHINE

This application claims priority under 35 U.S.C. § 119 to patent application no. DE 10 2017 213 760.6, filed on Aug. 8, 2017 in Germany, the disclosure of which is incorporated herein by reference in its entirety.

BACKGROUND

The disclosure relates to an axial piston machine with hydrostatic relief of its pivot cradle.

In the case of axial piston machines with a swashplate design, piston feet are coupled to a pivot cradle which is pivotable in respect of a housing, in order to adjust the stroke volume. For this purpose, slide bearings are provided in arc form between the fixed or stationary housing and the movable pivot cradle.

The working pressure of the cylinder/piston combinations concerned give rise to high supporting forces which are transferred from the pistons via the piston feet to the pivot cradle and which have to be transferred to the housing via the slide bearing. For this purpose, a slide bearing is usually provided in each case on both sides of a central drive shaft on the pivot cradle, wherein the slide bearing assigned to the high-pressure side has to bear substantially higher supporting forces than the slide bearing assigned to the low-pressure side. So that these high supporting forces can be partially compensated, it is known from the state of the art for hydrostatic relief to be provided in the slide bearing concerned or in the two slide bearings.

The hydrostatic relief mainly has recesses or cavities which may, in particular, be formed on the convex bearing faces on the pivot cradle side or on the concave bearing faces on the housing side. The recesses are supplied with relief pressure medium via pressure medium channels on the housing side or the pivot cradle side.

Publication DE 37 24 285 C2 discloses an axial piston machine with a pivot cradle bearing which has a slide bearing shell on the housing side. This extends integrally on both sides of the drive shaft. On each side of the slide bearing shell are provided two relief grooves which are parallel to one another. These are supplied with relief pressure medium separately from one another and successively in time. The pressure medium is supplied via bores which are on the pivot cradle side and therefore are moved relative to the fixed or stationary relief grooves.

Publication DE 10 2011 121 523 A1 shows hydrostatic relief in the form of a zigzag-shaped relief groove which extends via a central region of the bearing face on the pivot cradle side. The relief groove is supplied with relief pressure medium via a supply channel likewise running through the pivot cradle.

It is furthermore known in the art for even larger pressure fields to be formed as hydrostatic relief.

Publication DE 10 2012 214 830 A1 shows relief recesses which are delimited via their edge contours, whereby relief pressure fields are defined. The disadvantage of this is that the relief recess is not available as a supporting bearing face of the slide bearing.

This disadvantage is offset by publication U.S. Pat. No. 4,710,107. FIG. 2 shows a circumferential closed relief groove which is supplied with relief pressure medium via two bores which open directly into the groove.

Publication DE 21 01 078 also offsets the disadvantage of the bearing faces which are made significantly smaller by the relief pressure fields. FIG. 2 shows a closed relief groove in the form of an angular eight which is supplied with relief pressure medium via a central bore opening directly into the groove.

In the case of the two aforementioned publications, the same pressure will prevail overall following a sufficiently long operation, even in the region or regions within the circumferential relief groove. During actual operation, reduced relief pressure will prevail in the middle of the region or in the regions between the relief groove.

The disadvantage of the hydrostatic relief in the two aforementioned publications is that the relief grooves arranged at right angles to one another are difficult to produce. In the case of production using a disk-milling cutter, for example, this must be pivoted through 90°. In particular, it is difficult to produce the two connection grooves on the short sides of the relief pressure field or the two relief pressure fields using a disk-milling cutter, as this must also be positioned obliquely due to the curvature of the bearing face in addition to the pivoting.

By contrast, the disclosure is based on the problem of creating an axial piston machine in which the aforementioned production disadvantages are avoided in respect of the hydrostatic relief.

SUMMARY

This problem is solved by an axial piston machine having the features disclosed herein.

The hydrostatic axial piston machine claimed has a pivot cradle for adjusting a stroke volume which is mounted in a housing via a slide bearing. The slide bearing has a first pair of bearing faces, in particular on the high-pressure side, and a second pair of bearing faces, in particular on the low-pressure side. At least the first pair of bearing faces has at least two hydrostatic relief grooves spaced apart from one another on one of its bearing faces, which relief grooves extend in a circumferential direction of the bearing face starting from a depression. The two relief grooves are connected to one another fluidically via the depression and can therefore be exposed to roughly the same pressure. According to a first variant according to the disclosure, the two relief grooves are closed at their end portions spaced apart from one another oriented in the circumferential direction. According to a second variant in accordance with the disclosure, a partial region of a bearing face is arranged between the two end portions of the relief grooves spaced apart from one another oriented in the circumferential direction.

The area designations should be understood to mean that the relief grooves, including the depression plus the remaining bearing face, produce the total area face affected. A first relief pressure field is created in the region of the depression including the relief grooves and in the adjacent regions, in particular between the two relief grooves and the depression.

The two variants according to the disclosure can also be jointly implemented.

In each case, hydrostatic relief is created, the production whereof is simplified compared with the state of the art. The relief grooves and the depression can be directly introduced into the unmachined part (e.g. forging or casting). If the relief grooves and the depression are produced using a disk-milling cutter, this simplifies things in that through the omission of the connection groove running transversely to the circumferential direction, the difficult orientation of the disk-milling cutter referred to above no longer applies.

Further advantageous embodiments of the disclosure are described in the dependent patent claims.

Pivoting of the disk-milling cutter is also dispensed with when producing the depression if this has an extension in the circumferential direction which is greater than the width of the two relief grooves. The extension may, for example, roughly correspond to the length of the (first) relief groove. This means that no pivoting and also no tilting of the disk-milling cutter are necessary during the production of the entire hydrostatic relief. As stated above, the relief grooves and the depression can also be introduced straight into the unmachined part (e.g. forging or casting).

Two second relief grooves preferably extend from the depression against the circumferential direction. The second two relief grooves are also preferably closed at their end portions spaced apart from one another oriented against the circumferential direction and/or a partial region of the bearing face is also arranged between the two end portions spaced apart from one another against the circumferential direction.

If the pivot cradle is also pivotable from a zero-stroke position against the circumferential direction, the second relief grooves are roughly the same length as the first relief grooves. The combination of the center depression and the two pairs of relief grooves can then be roughly symmetrical.

If the pivot cradle can be pivoted out of a zero-stroke position only in the circumferential direction to the short grooves, the second relief grooves are longer than the first relief grooves. The hydrostatic relief is therefore optimally adapted to the force and pressure conditions of the one-sided pivoting.

The depression is preferably deeper than the relief grooves.

According to a first exemplary embodiment, the depression is fluidically connected to a pressure medium channel which runs through the pivot cradle. The pressure medium channel can then be connected in a pulsating or periodic manner to cylinder chambers in the engine of the axial piston machine.

According to a second exemplary embodiment, the pressure medium channel is arranged on the housing side. The pressure medium supply can be tapped by a high-pressure kidney and realized with channels on the housing side.

In a preferred embodiment of the axial piston machine according to the disclosure, the arrangement is formed from the depression and relief grooves in a concave bearing face of a bearing shell on the housing side which is fastened to the housing by a screw, in which the pressure medium channel is arranged.

The pressure medium channel preferably opens out in a central plane of the housing or the pivot cradle which also defines the zero-stroke position of the pivot cradle.

What is simpler in production terms is for the configuration of the depression and relief grooves to be arranged on a convex bearing face of the first pair which is on the pivot cradle side.

It is particularly preferable for the extension of the depression in the circumferential direction to be large enough for the pressure medium channel always to open out in the depression. In other words, the extension of the depression in the circumferential direction is at least as large as a path covered by an opening of the pressure medium channel on the bearing face concerned.

The second pair of bearing faces may also have hydrostatic relief, the relief force whereof is smaller than that of the first pair of bearing faces.

For this purpose, the hydrostatic relief of the second pair may have a second pressure medium channel which opens into a second relief pressure field which is a partial region of the two bearing faces.

The second pair of bearing faces may exhibit a first limiting groove and a second limiting groove via which the second relief pressure field is delimited. The two limiting grooves are preferably spaced apart from one another for this purpose in one of the bearing faces of the second pair and relieved in relation to the inner chamber of the housing.

The first limiting groove preferably extends in the circumferential direction starting from the second relief pressure field, while the second limiting groove extends against the circumferential direction starting from the second relief pressure field. The two limiting grooves are connected to an inner chamber of the housing via their end portions pointing away from one another. The circumferential direction of the second pair of bearing shells corresponds to the circumferential direction of the first pair of bearing shells arranged on the other side of a drive shaft.

If the pivot cradle is pivotable from the zero-stroke position against the circumferential direction too, the two limiting grooves of the second pair are roughly the same length. The combination of limiting grooves is preferably roughly symmetrical.

If the pivot cradle is pivotable from a zero-stroke position only in the circumferential position to the first limiting groove, the second limiting groove is longer than the first limiting groove. The hydrostatic relief of the second pair is therefore also optimally adapted to the force and pressure conditions of the one-sided pivoting.

The area designations should be understood to mean that the limiting grooves plus the remaining bearing face produce the total bearing face on the low-pressure side. The second relief pressure field is formed in the region of the opening of the pressure medium channel, in particular between the limiting grooves.

In terms of production, the relief grooves and/or limiting grooves may simply be parallel or radial or (apart from the curve of the bearing face concerned) curved or (apart from the bend of the bearing face) bent.

BRIEF DESCRIPTION OF THE DRAWINGS

An exemplary embodiment of an axial piston machine according to the disclosure is depicted in the drawings. The disclosure will now be explained in greater detail with the help of the figures in these drawings.

In the drawings.

DETAILED DESCRIPTION

Figure 1:
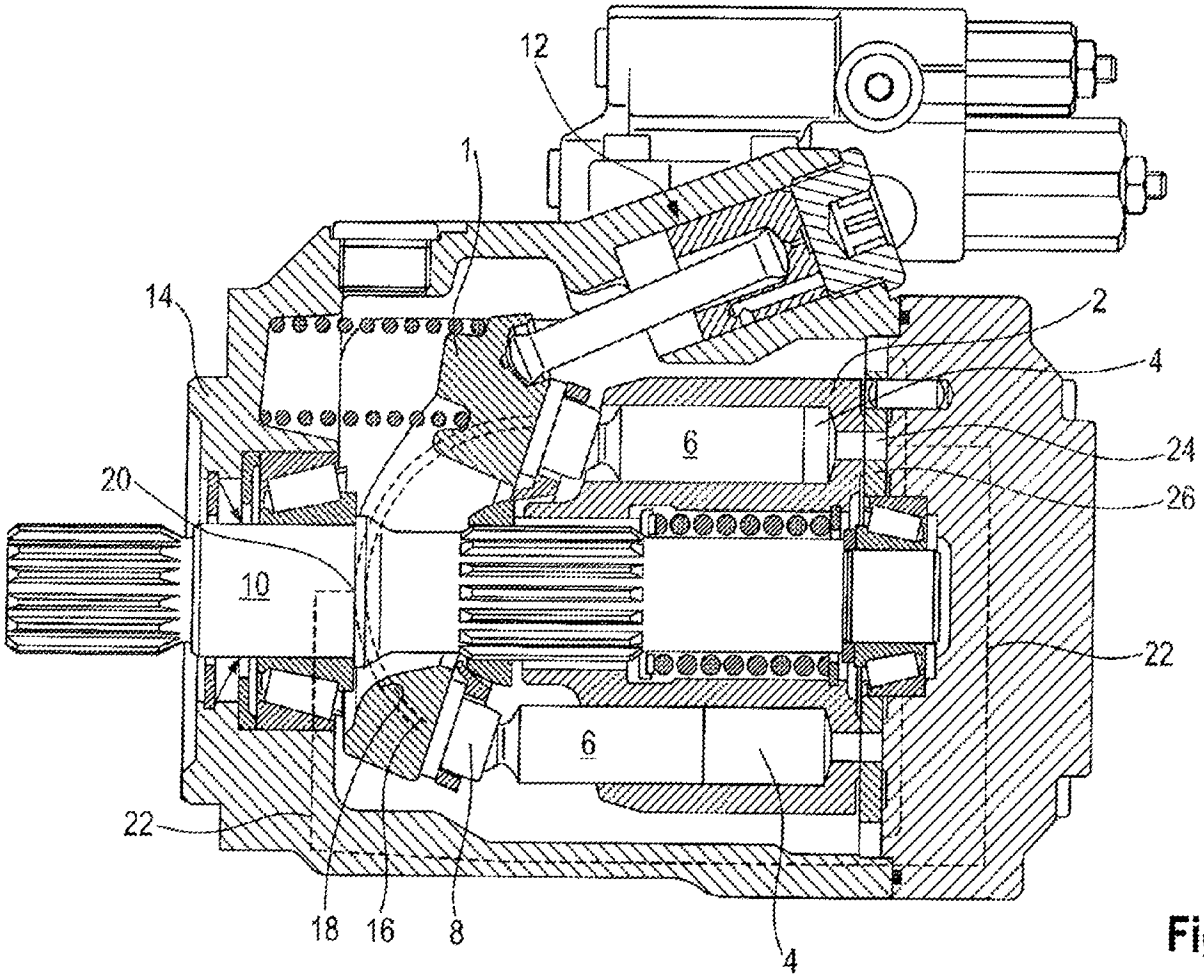
FIG. 1 shows a longitudinal section of the exemplary embodiment of the axial piston machine according to the disclosure.

FIG. 1 shows a longitudinal section of the exemplary embodiment of the axial piston machine according to the disclosure. It is designed in terms of its conveying volume as a one-quadrant pump and, for this purpose, has a pivot cradle 1 and a cylinder drum 2, in each of the cylinder chambers 4 whereof pistons 6 are guided, the piston feet whereof being guided along the pivot cradle 1 via piston shoes 8. The pivot cradle 1 and the cylinder drum 2 have a drive shaft 10 passing through them, wherein with zero-stroke operation of the axial piston machine, the swashplate 1 is positioned perpendicular to the drive shaft 10. So that during each rotation of the cylinder drum 2 with the drive shaft 10 a lifting movement of the pistons 6 can be generated in the respective cylinder chambers 4, the pivot cradle 1 is pivoted via an adjusting device 12 (e.g. into the oblique position shown in FIG. 1).

In order to facilitate the corresponding relative movement between the pivot cradle 1 and a housing 14 of the axial piston machine during pivoting, a first and a second arcuate slide bearing are provided between the pivot cradle 1 and the housing 14. The first slide bearing is arranged above the drawing plane in FIG. 1 and is therefore only drawn in dotted lines. The second slide bearing is arranged below the drawing plane and is not shown.

The first slide bearing has a first concave bearing face 16 on the pivot cradle side which is supported on a first convex bearing face 18 on the housing side. The bearing face 16 on the pivot cradle side is formed straight on the pivot cradle, while the bearing face 18 on the housing side is configured on a bearing shell 54 which is fastened to the housing 14 by a screw 56 as shown in FIG. 5.

Figure 5:
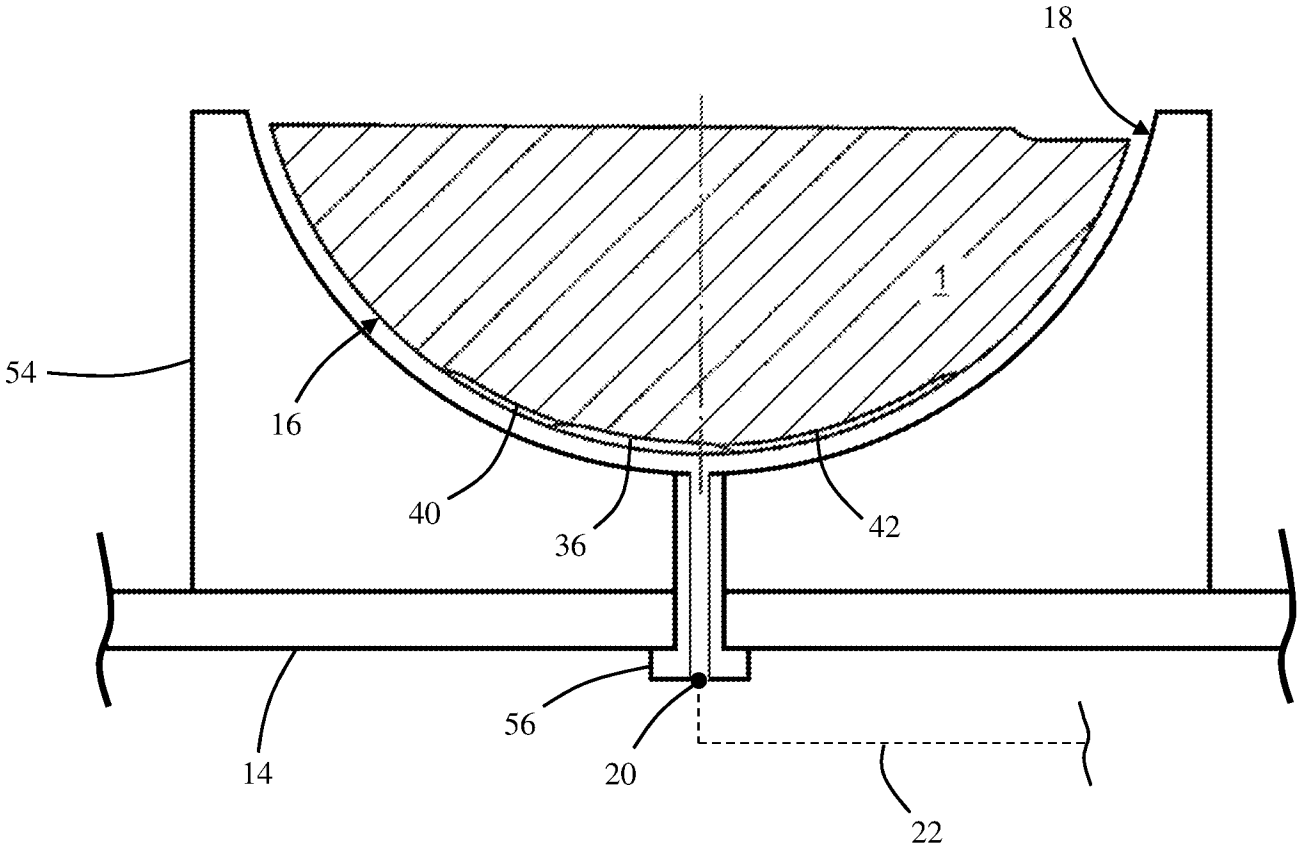
FIG. 5 shows a partial section view of the pivot cradle supported on a bearing shell of the axial piston machine from FIG. 1.

An opening 20 of a pressure medium channel 22 is provided in the screw 56 as shown in FIG. 5. Relief pressure medium is removed from a kidney-shaped high-pressure opening 24 in a distributor plate 26 via the pressure medium channel 22. Consequently, during operation of the axial piston machine, relief pressure medium for hydrostatic relief is always supplied via the pressure medium channel 22 and via the opening 20 which is formed between the two bearing faces 16, 18 and which is explained more accurately with reference to the following figures.

The second slide bearing also has a second bearing face on the pivot cradle side and a second bearing face on the housing side. The second slide bearing also has hydrostatic relief with a pressure medium channel and an opening.

During operation of the one-quadrant pump, a direction of rotation is assumed which means that the piston 6 is exposed to high pressure in the region above the drawing plane and to low pressure in the region below the drawing plane in FIG. 1. This means that the first slide bearing (depicted using dotted lines in FIG. 1) is the slide bearing on the high-pressure side and is therefore exposed to greater forces than the second slide bearing.

Figure 2:
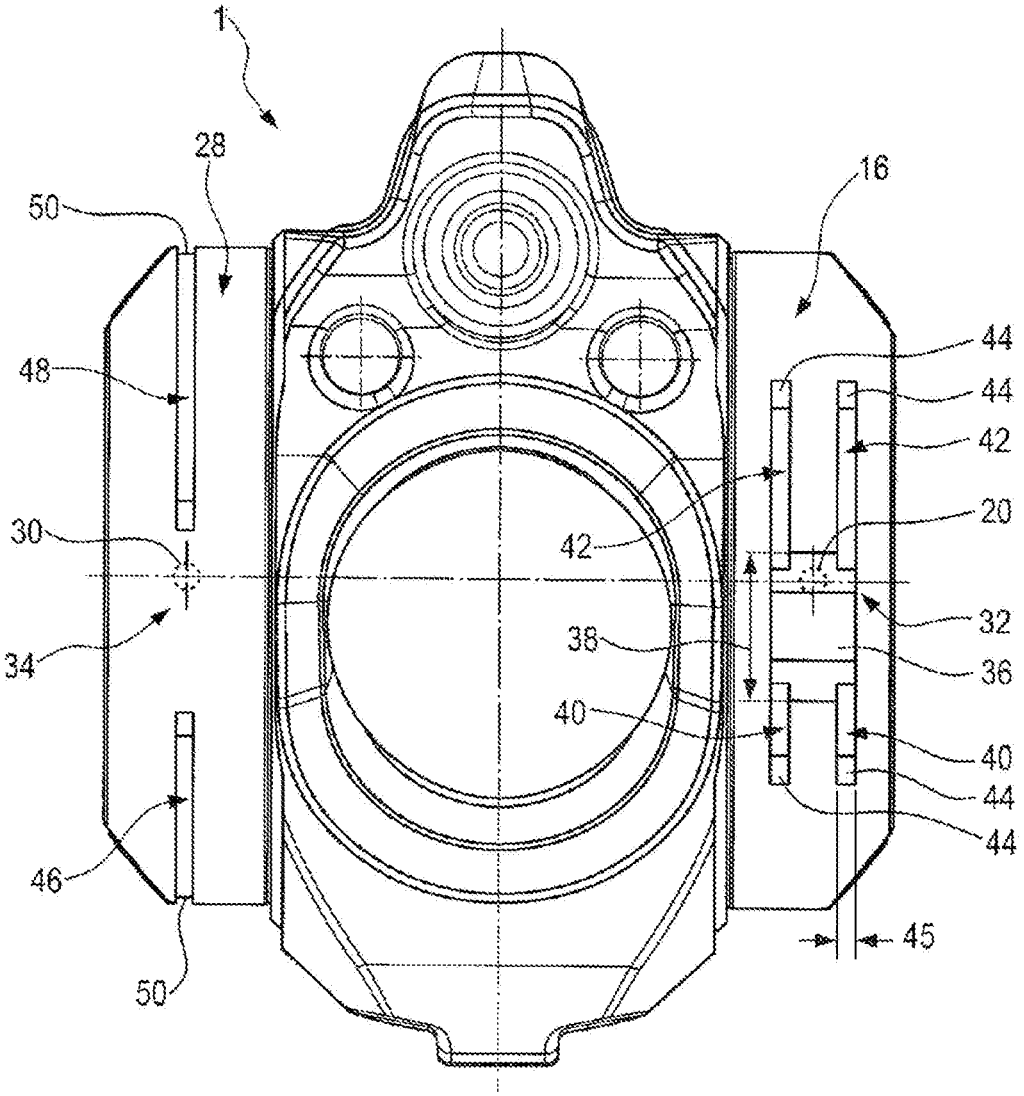
FIG. 2 shows a view of the pivot cradle of the axial piston machine from FIG. 1.

FIG. 2 shows a view of the pivot cradle 1 of the axial piston machine from FIG. 1. In this case, the concave first bearing face 16 on the pivot cradle side from FIG. 1 and, moreover, also the second bearing face 28 on the pivot cradle side are depicted. In the assembled state of the axial piston machine, the respective bearing shells on the housing side with their bearing faces are arranged above the plane of projection of the two bearing faces 16, 28 on the pivot cradle side, of which bearing faces only bearing face 18 is depicted in FIG. 1. The respective opening 20, 30 for the supply of relief pressure medium for the respective hydrostatic relief is arranged in these bearing shells or bearing faces 18 (depicted using dotted lines in FIG. 2). Since the exemplary embodiment of the axial piston machine shown is designed as a one-quadrant pump, the pistons 6 exposed to high pressure are always largely supported on the first bearing face 16 on the pivot cradle side (on the right in FIG. 2), while the piston exposed to low pressure is always largely supported on the second bearing face 28 on the pivot cradle side.

Since the pivot cradle 1 in FIG. 2 is shown in its central zero-stroke position, the two openings 20, 30 are arranged in a central position in each case with respect to the bearing faces 16, 28. Since the one-quadrant pump is only pivotable on one side, the openings 20, 30 can only be moved downward relative to the pivot cradle 1 from the position shown in FIG. 2. To be more precise, the bearing faces 16, 28 move through upward during the pivoting-out in FIG. 2 and below the two openings 20, 30.

A first relief pressure field 32 on the high-pressure side develops about the first opening 20, while a second relief pressure field 34 on the low-pressure side develops about the second opening 30. The first relief pressure field 32 is fed via a roughly rectangular depression 36, the extension 38 whereof in the circumferential direction being greater than the maximum path covered by the first opening 20 relative to the pivot cradle 1. In this way, the first opening 20 is always fluidically connected to the depression 36.

On the short side of the depression 36 (the lower side in FIG. 2), two relief grooves 40 extend in a first circumferential direction, while from the short side of the depression 36 (upper side in FIG. 2), two second relief grooves 42 extend toward the circumferential direction. The first two relief grooves 40 and the second two relief grooves 42 are each parallel to one another. On each of their outer end portions 44 facing away from the depression 36, the relief grooves 40, 42 are bent and flattened. This means that the relief grooves 40, 42 are to a certain extent fluidically closed at their end portions 44. This means that a partial region of the bearing face remains between the two end portions 44 of each pair of relief grooves 40, 42, which bearing face has no recess and is used for the mechanical support of the first bearing face 16 on the pivot cradle side in relation to the first bearing face 18 on the housing side (cf. FIG. 1).

The first two relief grooves 40 are shorter than the second two relief grooves 42. This means that the relief pressure of the opening 20 is distributed over the depression 36 and the four grooves 40, 42 between the first bearing face 16, 18 and also extends over the surrounding regions of the bearing face, in particular between the pairs of relief grooves 40, 42. The relief grooves 40, 42 each have a width 45 that extends roughly perpendicular to the circumferential direction. The extension 38 of the depression 36 in the circumferential direction is greater than the width 45 of the relief grooves 40, 42.

On the second bearing face 28 on the pivot cradle side which supports the side of the pivot cradle 1 along which the pistons 6 exposed to low pressure run, the hydrostatic relief is smaller and weaker. The second relief pressure field 34 is created around the second opening 30 in the bearing face of the second bearing faces 28. The size of the second relief pressure field 34 is limited by a first limiting groove 46 and a second limiting groove 48. In this case, both limiting grooves 46, 48 have an opening 50 on their respective end portion spaced apart from the second relief pressure field 34. By this means, the respective limiting groove 46, 48 is connected to the inner chamber of the housing 14 (cf. FIG. 1) and therefore relieved.

Since the pivot cradle 1 shown—as explained above—is only designed to pivot in one direction, the two limiting grooves 46, 48 and the relief pressure field 34 defined therebetween are asymmetrical. To be more precise, the first limiting groove 46 which extends in the circumferential direction (downward in FIG. 2) is shorter than the second limiting groove 48 which extends against the circumferential direction. This means that in the central position of the pivot cradle 1 shown in FIG. 2, the relief pressure field 34 extends predominantly in the circumferential direction (downward in FIG. 2). The spacing of the two limiting grooves 46, 48 is sufficiently great for the second opening 30 to remain adjacent to the second relief pressure field 34 formed in the bearing face, even with complete pivoting of the pivot cradle 1.

Figure 3:
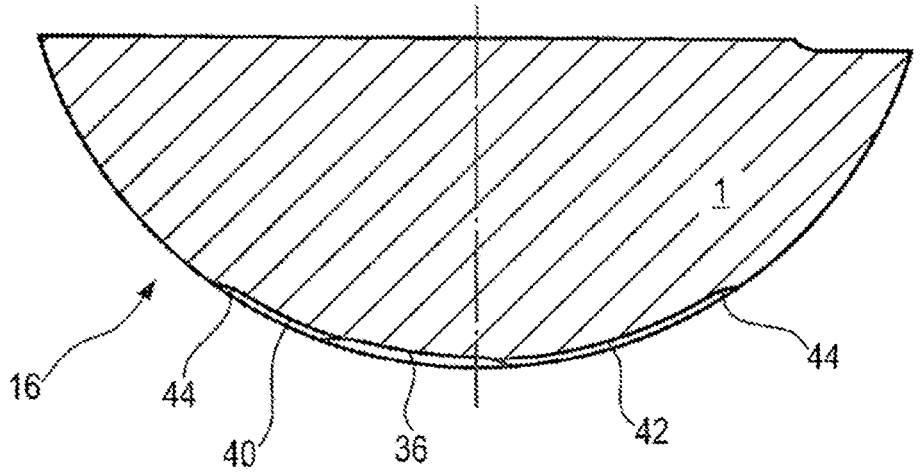
FIG. 3 shows a first section of the pivot cradle from FIG. 2.

FIG. 3 shows a cross section through the pivot cradle from FIG. 2 in the region of its first bearing face 16. In this case, the sectional plane is positioned through one of the first two shorter relief grooves 40 and, accordingly, one of the second two longer relief grooves 42. This means that the sectional plane also runs through the depression 36. It can be seen that the depression 36 is deeper than the two relief grooves 40, 42. Furthermore, it is shown that a bend is formed on each of the two end portions 44 of the relief grooves 40, 42 which corresponds to an arc of the disk-milling cutter used. The relief grooves 40, 42 are closed at these end portions 44.

Figure 4:
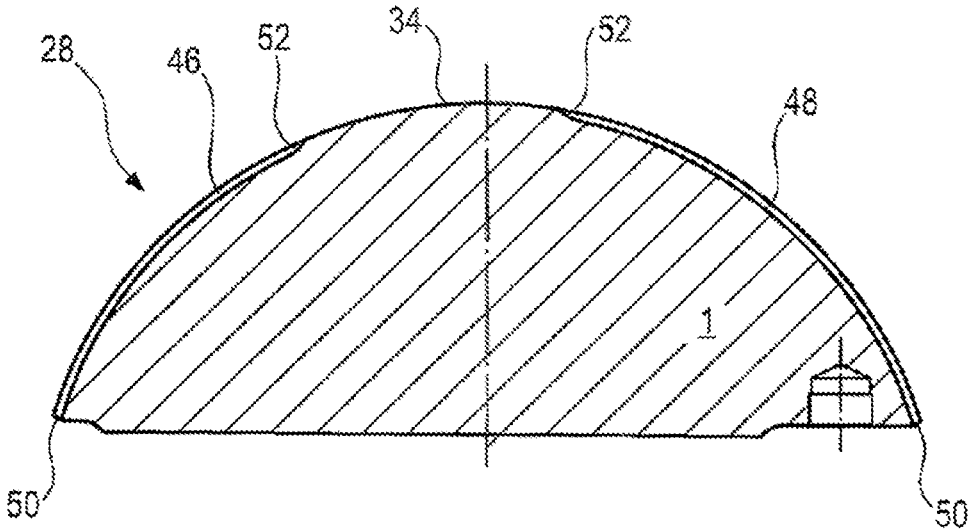
FIG. 4 shows a second section of the pivot cradle from FIG. 2.

FIG. 4 shows a similar cross section through the pivot cradle 1, wherein the sectional plane lies in the limiting grooves 46, 48 of the second bearing face 28. It can be seen that the limiting grooves 46, 48 have openings 50 at their outer end portions, so that the limiting grooves 46, 48 are relieved and therefore delimit the second relief pressure field 34 arranged between them. Bends 52 can be seen in the transition between the relief pressure field 34 and the limiting grooves 46, 48 which likewise correspond to the arc of the disk-milling cutter used.

All recesses 36, 40, 42, 46, 48 shown in FIGS. 3 and 4 can be produced using the aforementioned disk-milling cutter, wherein this can always be guided parallel to the sectional planes or in the sectional planes in FIGS. 3 and 4 and need not be pivoted or tilted in respect thereof.

Unlike in the exemplary embodiment shown, the axial piston machine may also be freely pivotable, in which case in the central position of the pivot cradle 1 shown in FIG. 2, the depression 36 is central below the first opening 20 and the first relief grooves 40 are as long as the second relief grooves 42. With regard to the second bearing shell 28 on the pivot cradle side, the second relief pressure field 34 is arranged centrally below the second opening 30 and the first limiting groove 46 is as long as the second limiting groove 48.

Unlike in the exemplary embodiment described, the relief grooves and the depressions and limiting grooves can also be directly introduced into the bearing faces on the pivot cradle side (e.g. forging or casting) without the disk-milling cutter.

A hydrostatic axial piston machine with a pivot cradle is disclosed, wherein at least one slide bearing of the pivot cradle on the high-pressure side is hydrostatically relieved. For this purpose, the slide bearing has one or two pairs of relief grooves, about which and between which a relief pressure field develops, as the grooves are supplied with relief pressure medium on one side and are closed at their outer ends. An optional slide bearing on the low-pressure side has one or two limiting grooves which delimit the relief pressure field there, as the limiting grooves are open at their outer ends, for example.

LIST OF REFERENCE NUMBERS

1 Pivot cradle
2 Cylinder drum
4 Cylinder chamber
6 Piston
8 Piston shoe
10 Drive shaft
12 Adjusting device
14 Housing
16 First bearing face on the pivot cradle side
18 First bearing face on the housing side
20 First opening
22 Pressure medium channel
24 High-pressure opening
26 Distributor plate
28 Second bearing face on the pivot cradle side
30 Second opening
32 First relief pressure field
34 Second relief pressure field
36 Depression
38 Extension
40 First relieving groove
42 Second relieving groove
44 End portion/bend
46 First limiting groove
48 Second limiting groove
50 Opening
52 Bend

What is claimed is:

1. A hydrostatic axial piston machine, comprising:

a housing; and a pivot cradle configured to adjust a stroke volume and mounted in the housing via a slide bearing, the slide bearing having a first pair of bearing faces and a second pair of bearing faces, a bearing face of at least the first pair of bearing faces including a depression, wherein at least two hydrostatic relief grooves spaced apart from one another extend from the depression in a circumferential direction of the bearing face such that the at least two hydrostatic relief grooves are configured to be exposed to the same relief pressure, wherein the depression and the at least two hydrostatic relief grooves form a part of a first pressure relief field, wherein (i) the at least two hydrostatic relief grooves are closed at two end portions of the at least two hydrostatic relief grooves spaced apart from one another oriented in a circumferential direction, and/or (ii) a partial region of the bearing face is arranged between the two end portions of the at least two hydrostatic relief grooves spaced apart from one another oriented in the circumferential direction, and wherein the depression includes an extension in the circumferential direction which is greater than a width of the at least two hydrostatic relief grooves.

2. The hydrostatic axial piston machine according to claim 1, further comprising:

at least two second relief grooves extending from the depression against the circumferential direction, wherein (i) the at least two second relief grooves are closed at two second end portions of the at least two second relief grooves spaced apart from one another oriented against the circumferential direction and/or (ii) a further partial region of the bearing face is arranged between the two second end portions of the at least two second relief grooves spaced apart from one another against the circumferential direction.

3. The hydrostatic axial piston machine according to claim 2, wherein the depression is deeper than the at least two hydrostatic relief grooves and the at least two second relief grooves.

4. The hydrostatic axial piston machine according to claim 2, wherein the depression is fluidically connected to a pressure medium channel arranged on a housing side.

5. The hydrostatic axial piston machine according to claim 4, wherein:

a further bearing face on the housing side is formed on a bearing shell, the bearing shell fastened to the housing via a screw; and a portion of the pressure medium channel is arranged in the screw.

6. The hydrostatic axial piston machine according to claim 4, wherein the at least two hydrostatic relief grooves, the at least two second relief grooves, and the depression are arranged on the bearing face of the first pair of bearing faces on a pivot cradle side.

7. The hydrostatic axial piston machine according to claim 1, wherein the depression is fluidically connected to a pressure medium channel arranged on a pivot cradle side.

8. The hydrostatic axial piston machine according to claim 7, wherein the pressure medium channel is configured to be connected to cylinder chambers.

9. The hydrostatic axial piston machine according to claim 7, wherein:

the second pair of bearing faces includes a second relief pressure field; and a second pressure medium channel opens into the second relief pressure field.

10. The hydrostatic axial piston machine according to claim 9, further comprising:

a first limiting groove and a second limiting groove delimiting the second relief pressure field, wherein the first and second limiting grooves are spaced apart from one another in a second bearing face of the second pair of bearing faces and connected to an inner chamber of the housing via an opening.

11. The hydrostatic axial piston machine according to claim 10, wherein:

the first limiting groove starting from the second relief pressure field extends in a circumferential direction;

the second limiting groove starting from the second relief pressure field extends against the circumferential direction; and the first and second limiting grooves are connected to the inner chamber at end portions of the first and second limiting grooves pointing away from one another.

12. The hydrostatic axial piston machine according to claim 10, wherein the second limiting groove is longer than the first limiting groove.

13. A hydrostatic axial piston machine, comprising:

a housing; and a pivot cradle configured to adjust a stroke volume and mounted in the housing via a slide bearing, the slide bearing having a first pair of bearing faces and a second pair of bearing faces, a bearing face of at least the first pair of bearing faces including a depression, wherein at least two hydrostatic relief grooves spaced apart from one another extend from the depression in a circumferential direction of the bearing face such that the at least two hydrostatic relief grooves are configured to be exposed to the same relief pressure, wherein the depression and the at least two hydrostatic relief grooves form a part of a first pressure relief field, wherein (i) the at least two hydrostatic relief grooves are closed at two end portions of the at least two hydrostatic relief grooves spaced apart from one another oriented in a circumferential direction, and/or (ii) a partial region of the bearing face is arranged between the two end portions of the at least two hydrostatic relief grooves spaced apart from one another oriented in the circumferential direction, wherein at least two second relief grooves extend from the depression against the circumferential direction, wherein (i) the at least two second relief grooves are closed at two second end portions of the at least two second relief grooves spaced apart from one another oriented against the circumferential direction and/or (ii) a further partial region of the bearing face is arranged between the two second end portions of the at least two second relief grooves spaced apart from one another against the circumferential direction, and wherein the at least two second relief grooves are longer than the at least two hydrostatic relief grooves.

14. A hydrostatic axial piston machine, comprising:

a housing; and a pivot cradle configured to adjust a stroke volume and mounted in the housing via a slide bearing, the slide bearing having a first pair of bearing faces and a second pair of bearing faces, a bearing face of at least the first pair of bearing faces including a depression, wherein at least two hydrostatic relief grooves spaced apart from one another extend from the depression in a circumferential direction of the bearing face such that the at least two hydrostatic relief grooves are configured to be exposed to the same relief pressure, wherein the depression and the at least two hydrostatic relief grooves form a part of a first pressure relief field, wherein (i) the at least two hydrostatic relief grooves are closed at two end portions of the at least two hydrostatic relief grooves spaced apart from one another oriented in a circumferential direction, and/or (ii) a partial region of the bearing face is arranged between the two end portions of the at least two hydrostatic relief grooves spaced apart from one another oriented in the circumferential direction, wherein the depression is fluidically connected to a pressure medium channel arranged on a housing side, wherein the at least two hydrostatic relief grooves and the depression are arranged on the bearing face of the first pair of bearing faces on a pivot cradle side, and wherein an extension of the depression in the circumferential direction is configured such that the pressure medium channel always opens into the depression.

* * * * *